United States Patent [19]

Hawkins et al.

[11] 4,174,880

[45] Nov. 20, 1979

[54] SPADE TERMINAL

[75] Inventors: Harold G. Hawkins, Bristolville, Ohio; Andrew F. Rodondi, Sharpsville, Pa.

[73] Assignee: General Motors Corporation, Detroit, Mich.

[21] Appl. No.: 872,474

[22] Filed: Jan. 26, 1978

[51] Int. Cl.[2] ..... H01R 9/00

[52] U.S. Cl. ..... 339/217 S; 339/223 R; 339/276 T

[58] Field of Search ..... 339/217 S, 223, 276 T

[56] References Cited

U.S. PATENT DOCUMENTS

| | | | |
|---|---|---|---|
| 731,400 | 6/1903 | Worthington | 339/223 R |
| 3,530,429 | 9/1970 | Scheller | 339/217 S |
| 3,555,496 | 1/1971 | Pearce et al. | 339/223 R |
| 4,067,633 | 1/1978 | Groft et al. | 339/74 R |

*Primary Examiner*—Gerald A. Dost
*Attorney, Agent, or Firm*—F. J. Fodale

[57] ABSTRACT

A spade terminal of unitary sheet metal construction comprises a flanged forward portion, a triple layer median portion and a rearward attachment portion. The flanges extend in opposite direction to a height equal to a layer thickness. The triple layer median portion comprises upper and lower wings which terminate short of opposite longitudinal sides so that each longitudinal side is a double layer. This configuration permits use with an insulator body having guide channels for the forward and median portions of the terminal which can be made in a butt cored mold.

3 Claims, 7 Drawing Figures

SPADE TERMINAL

This invention relates to spade terminals and more specifically to spade terminals of unitary sheet metal construction.

U.S. Pat. No. 3,555,496 granted to Warren Pearce, Jr. and James L. Winger, Jan. 12, 1971 for a "Male Connector Terminal and Insulator" discloses a spade terminal 10 of unitary sheet metal construction. As stated in an object of the specification, the Pearce et al invention provides a spade terminal which can be made from relatively thin gauge metal stock and is of low profile and small width but yet is substantially rigid to resist bending and flexing.

The Pearce et al spade terminal has been made by the Packard Electric Division of General Motors Corporation for a number of years and is considered commercially successful.

The Pearce et al spade terminal, however, generates a problem when used in combination with a molded insulator body of the type shown in the Pearce et al patent which has guide channels for the single layer forward terminal portion 22 which are narrower than the guide channels 58 for the double folded or triple layer median terminal portion. This guide channel configuration is necessitated because the height at the longitudinal edges of the double folded median portion of the Pearce et al terminal is three times as great as the height at the longitudinal edges of the single layer forward terminal portion and requires the use of by-passing cores in molding the insulator body 12. Use of by-passing cores in molding is more difficult than using butt cores.

An important object of this invention is to provide a spade terminal having a multi-layered median portion which can be used with insulator bodies made in butt cored molds.

Another object of this invention is to provide a spade terminal having a multi-layered median portion in which the forward terminal portion has longitudinal edges of the same thickness as the corresponding longitudinal edges of the multi-layered median portion so that the terminal can be used with insulator bodies made in butt cored molds.

Other objects and features of the invention will become apparent to those skilled in the art as the disclosure is made in the following detailed description of a preferred embodiment of the invention as illustrated in the accompanying sheets of drawing in which.

Figure 2:
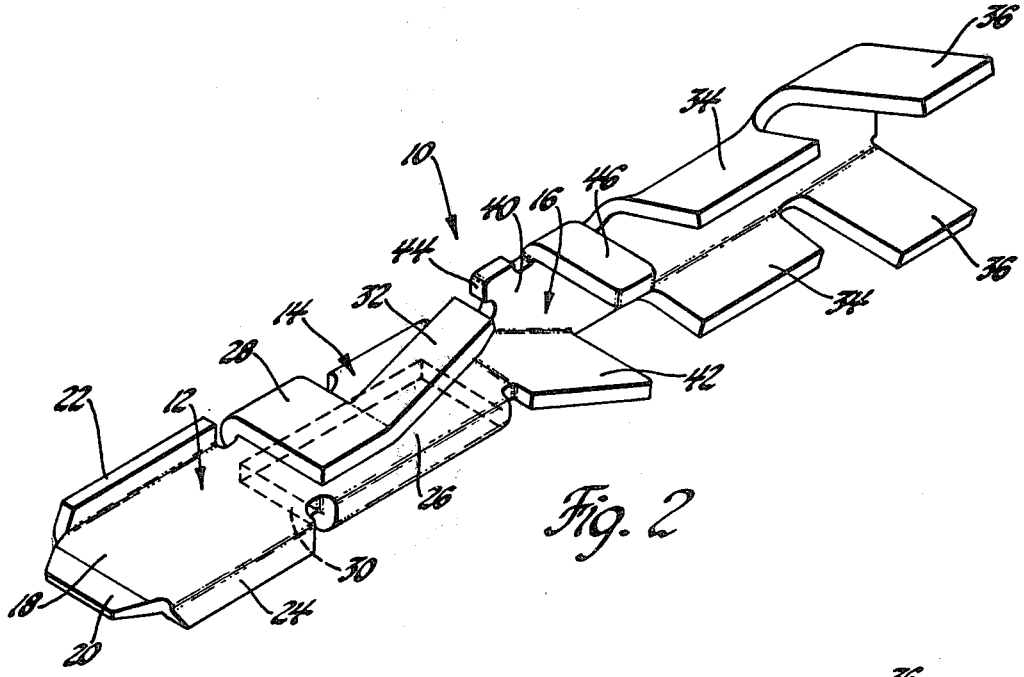
FIG. 2 is a perspective view of a spade terminal in accordance with this invention which is made from the blank shown in FIG. 1.
Figure 3:
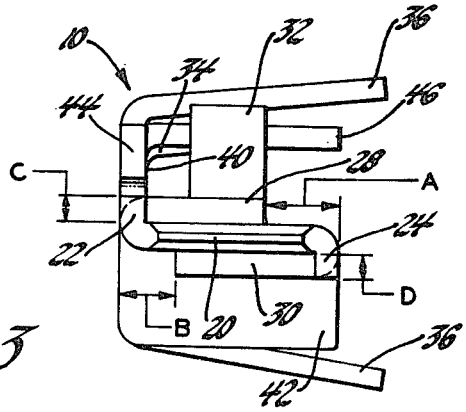
FIG. 3 is a front view of the spade terminal shown in FIG. 2.

Referring now to the drawing and particularly to FIGS. 2 and 3, this invention is embodied in a spade termial 10 of unitary sheet metal construction which generally comprises a forward flanged portion 12, a double folded median portion 14 and a rearward attachment portion 16.

The forward portion 12 comprises a flat section 18 having a coined tip 20 which constitutes an electrical contact for connection with a suitably designed female terminal (not shown). The forward portion 12 further comprises flanges 22 and 24 bent up from the opposite longitudinal sides of the flat section 18. The flanges 22 and 24 extend in opposite direction and are related to the double folded median portion 14 in a manner explained in greater detail hereinafter.

The median portion 14 comprises a flat middle section 26 which is a planar continuation of the flat section 18 and which together with the flat section 18 comprises the main body portion of the terminal 10. The main body portion has wings 28 and 30 integrally connected to the opposite longitudinal sides of the middle section 26. The wing 28 is folded over onto the top surface of the middle section 26 and terminates short of the longitudinal side to which the wing 30 is integrally connected by a distance A. The wing 30 is folded over onto the bottom surface of the middle section 26 and terminates short of the longitudinal side to which the wing 28 is connected by a distance B.

While the distances A and B are shown as substantially greater than the common width of the flanges 22 and 24, it is merely necessary that the distances A and B be at least as great as the maximum widths of the flanges 24 and 22 respectively plus an allowance for manufacturing tolerances.

On the other hand it is also important that the heights C and D of the flanges 22 and 24 be substantially equal to the respective thicknesses of the wings 28 and 30 so that a guide channel of uniform height can accommodate the longitudinal sides of the forward flanged portion 12 and the double folded median portion 14.

As a practical matter the width of the flanges 24 and 22 are usually equal to the blank stock thickness and match the thickness of remaining sections of the terminal except for the coined sections such as the tip 20. Consequently, the distances A and B and heights C and D usually need be only as great as the thickness of the initial stock plus a reasonable allowance for manufacturing tolerances for the terminal and the insulator body.

The wing 28 also has an integrally connected, rearwardly extending flexible lock tang 32 which does not enter into the relationships discussed above because of its central location and generous spacing from the longitudinal sides of the main body portion.

Figure 5:
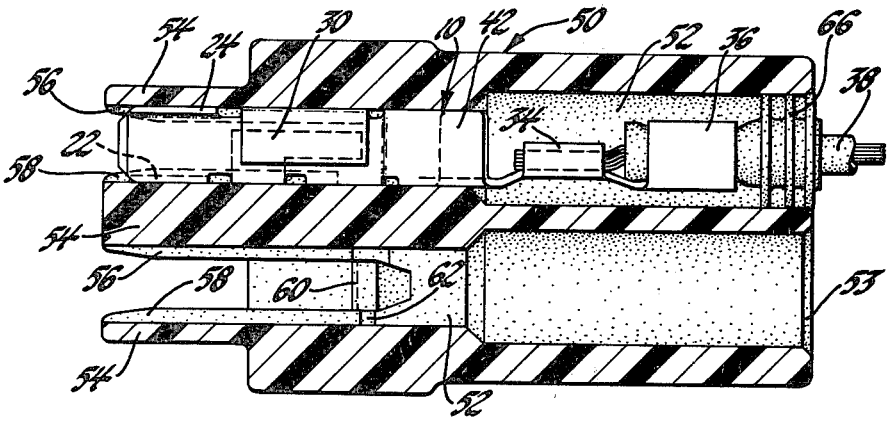
FIG. 5 is a section taken substantially along the line 5—5 of FIG. 4. One spade terminal is removed to show internal detail of the terminal receiving cavity.
Figure 6:
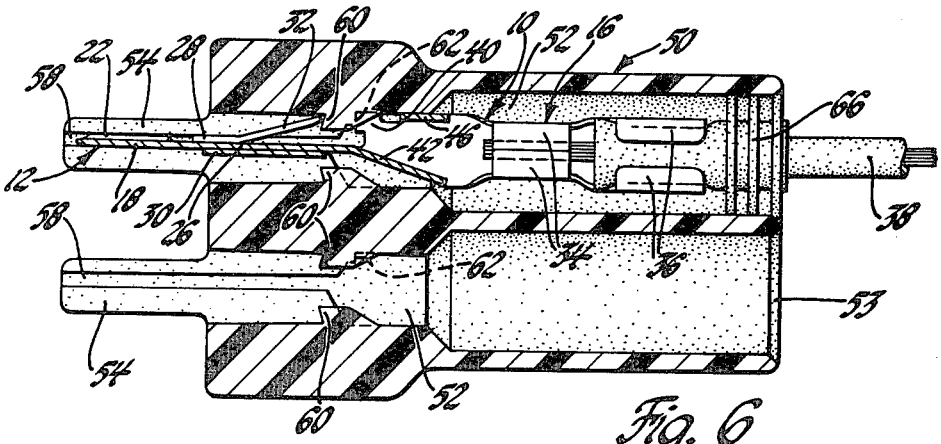
FIG. 6 is a section taken substantially along the line 6—6 of FIG. 4. One spade terminal is removed to show internal detail of the terminal receiving cavity.

The rearward attachment portion 16 of the spade terminal 10 comprises more or less conventional core and crimp barrels 34 and 36 for attaching the spade terminal 10 to a conductor 38 as shown in FIGS. 5 and 6. As best seen in FIG. 2, the attachment portion 16 is transversely oriented with respect to the main body portion and is connected to a downwardly slanted tail section 42 forming a part of the main body portion by a perpendicular wall 40 integrally joined to a longitudinal side of the tail section 42. A stop shoulder 44 at the face of the perpendicular wall 40 is spaced rearwardly of the free end of the flexible lock tang 32 to permit use of the terminal with a terminal locking type insulator body having cooperating lock and stop shoulders which can be made in a butt cored mold.

The rear attachment portion 16 also may include a transverse stabilizing tab 46.

Figure 1:
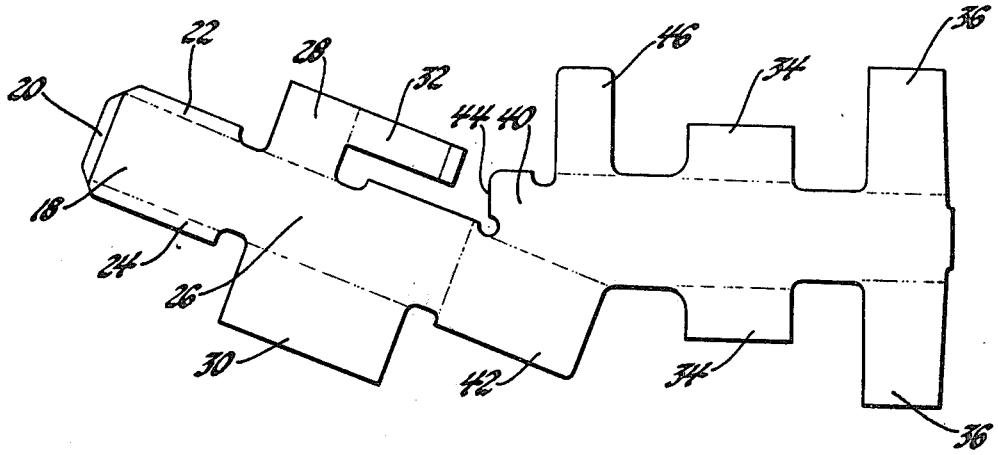
FIG. 1 is a plan view of a blank for making a spade terminal in accordance with this invention.

FIG. 1 shows the blank for the spade terminal 10. The blank is divided by phantom lines into parts identified by numerals corresponding to those identifying corresponding parts of the completed spade terminal 10.

Figure 4:
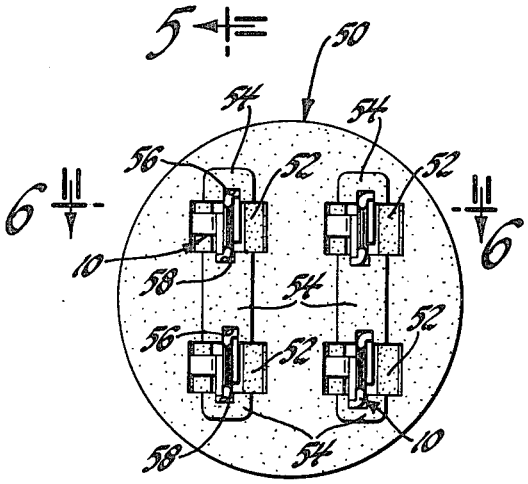
FIG. 4 is a front view of a multicavity insulator body carrying four spade terminals identical to the spade terminal shown in FIGS. 2 and 3.
Figure 7:
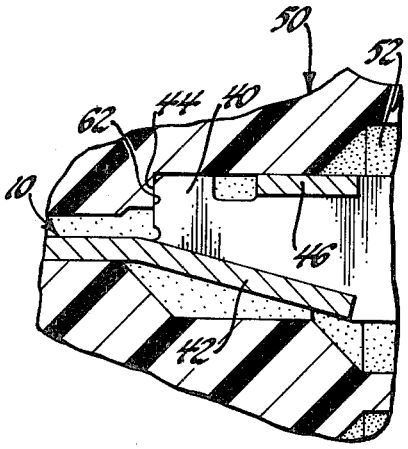
FIG. 7 is an enlargement of a portion of FIG. 6 with the connector body lock shoulders removed to illustrate internal detail.

Referring now to FIGS. 4, 5 and 6, there is shown a molded insulator body 50 having four open ended terminal receiving cavities 52, each of which receive a spade terminal 10 attached to a conductor 38 via their rearward open ends 53. The insulator body has six forwardly extending portions 54 which collectively provide four offset pairs of guide channels 56 and 58 associated with each of the respective four terminal receiving cavities 52 at their respective forward open ends.

Each guide channel extends a considerable distance into its associated cavity and is of sufficient height to accommodate a double thickness of the stock material for the terminal 10. The guide channel 56 thus receives and guides the longitudinal side of the main body portion having the flange 24 and the wing 30 connected to it. It does not have to accommodate wing 30 which terminates short of the longitudinal side by the distance B. Similarly, the opposite guide channel 58 receives and guides the doubly thick longitudinal side of the main body portion having the flange 22 and wing 28.

As shown in FIGS. 5 and 6 the guide channels 56 and 58 extend rearwardly to a location rearwardly of upper and lower lock shoulders 60 for the lock tang 32. Upper and lower lock shoulders 60 are provided because the terminal 10 may be inserted into the cavity 52 as shown or in a position rotated 180° about its longitudinal axis from the position shown. Further, the upper transition wall at the rear end of the channel 58 is stepped to provide a stop shoulder 62 rearwardly of the lock shoulder 60. The stop shoulder 62 cooperates with the stop shoulder 44 of the spade terminal 10 to prevent over-insertion. The lower transition wall at the rear end of the channel 56 is also stepped to provide a corresponding stop shoulder 62 when the terminal 10 is reoriented 180° from the position shown.

The forward portions of the cavities 52 are generally rectangular while the rearward portions behind the stabilizing tab 46 are enlarged to a circular shape to accommodate the crimp barrels 34 and 36 and receive a seal sleeve 66 secured to the conductor 38 by the terminal attachment portion 16. The sealing arrangement per se does not form a part of this invention.

We wish it to be understood that we do not desire to be limited to the exact details of construction shown and described, for obvious modifications will occur to a person skilled in the art.

What is claimed is:

1. A spade terminal of unitary sheet metal construction comprising a forward portion and a multi-layered median portion, said median portion having a flat section which is generally rectangular in plan form and a wing portion which is integrally attached to one longitudinal side of the flat section and folded over onto a surface thereof, said forward portion comprising a flat section coplanar with the flat section of the median portion and an upstanding flange at its longitudinal side corresponding to the one longitudinal side of the median portion, said flange having a height substantially equal to the thickness of the wing portion, and said wing portion terminating short of the opposite longitudinal side of the flat section whereby the longitudinal edges of the forward portion are of the same thickness as the corresponding longitudinal edges of the median portion.

2. A spade terminal of unitary sheet metal construction comprising a forward portion, a multi-layered median portion, and a rearward attachment portion, said median portion comprising a flat middle section which is generally rectangular in plan form and first and second wing portions which are integrally attached to opposite longitudinal sides of the middle section and folded over onto opposite surfaces thereof, said forward portion comprising a flat section coplanar with the middle section and first and second upstanding flanges at opposite longitudinal sides, said first and second upstanding flanges extending in opposite direction to a height substantially equal to the thicknesses of the first and second wing portions respectively, and each of said first and second wing portions terminating short of the longitudinal side to which the other of said first and second wings is integrally attached by a distance at least as great as the thickness of the one of said first and second upstanding flanges attached to the longitudinal side corresponding to that of the other wing.

3. A spade terminal of unitary sheet metal construction comprising a forward portion, a multi-layered median portion, and a rearward attachment portion, said median portion comprising a flat middle section which is generally rectangular in plan form and first and second wing portions which are integrally attached to opposite longitudinal sides of the middle section and folded over onto opposite surfaces thereof, said forward portion comprising a flat section coplanar with the middle section and first and second upstanding flanges at opposite longitudinal sides, said first and second upstanding flanges extending in opposite direction to a height substantially equal to the thicknesses of the first and second wing portions respectively, each of said first and second wing portions terminating short of the longitudinal side to which the other of said first and second wings is integrally attached by a distance at least as great as the thickness of the one of the first and second upstanding flanges attached to the longitudinal side corresponding to that of the other wing, one of said first and second wings having a flexible lock tang integrally attached thereto, said lock tang extending rearwardly and terminating in a free tip, and said rearward attachment portion having a forward facing stop shoulder which is spaced rearwardly of the free tip.

* * * * *